US010508460B2

(12) United States Patent
Frederick

(10) Patent No.: US 10,508,460 B2
(45) Date of Patent: Dec. 17, 2019

(54) WALL REPAIR APPARATUS

(71) Applicant: Amy Louise Frederick, Madison, WI (US)

(72) Inventor: Amy Louise Frederick, Madison, WI (US)

(73) Assignee: Amy Louise Frederick, Madison, WI (US)

( * ) Notice: Subject to any disclaimer, the term of this patent is extended or adjusted under 35 U.S.C. 154(b) by 31 days.

(21) Appl. No.: 15/694,646

(22) Filed: Sep. 1, 2017

(65) Prior Publication Data

US 2018/0066442 A1 Mar. 8, 2018

Related U.S. Application Data

(60) Provisional application No. 62/383,554, filed on Sep. 5, 2016.

(51) Int. Cl.
*E04G 23/02* (2006.01)

(52) U.S. Cl.
CPC ..... *E04G 23/0214* (2013.01)

(58) Field of Classification Search
CPC ..... E04G 23/0207; E04G 23/0214
USPC ..... 52/514, 514.5
See application file for complete search history.

(56) References Cited

U.S. PATENT DOCUMENTS 1,044,323 A 11/1912 Wiggin
3,215,243 A 11/1965 Dickerson
4,008,115 A 2/1977 Fairbanks et al.
4,100,712 A * 7/1978 Hyman ..... E04G 23/0203 52/514
4,122,222 A 10/1978 Parker
4,135,017 A 1/1979 Hoffmann, Sr.
4,285,183 A * 8/1981 Condit ..... E04G 23/0207 52/514
5,341,970 A * 8/1994 Woods ..... B05D 5/00 106/122
5,476,879 A * 12/1995 Woods ..... B05D 5/00 222/394
6,231,949 B1 5/2001 Hoffmann, Sr.
6,607,621 B1 8/2003 Brower
6,641,864 B2 * 11/2003 Woods ..... C09K 3/30 427/140
6,852,399 B2 2/2005 Takahashi et al.
7,259,329 B1 8/2007 Balma et al.
7,303,802 B1 12/2007 Brower et al.
7,316,835 B1 1/2008 Brower
7,380,382 B2 * 6/2008 Hansen ..... E04F 13/04 156/94
7,971,405 B2 * 7/2011 Hansen ..... E04F 13/04 156/94
8,021,505 B2 * 9/2011 Lewis ..... E04G 23/0203 156/71
9,539,798 B2 * 1/2017 Georgeson ..... B32B 3/266
(Continued)

*Primary Examiner* — Joshua J Michener
*Assistant Examiner* — James J Buckle, Jr.
(74) *Attorney, Agent, or Firm* — Quarles & Brady LLP

(57) ABSTRACT

A wall repair apparatus comprising a body, a top surface, a bottom surface, and an edge or a perimeter comprising a plurality of irregularly spaced protrusions of variable length and variable depth. The plurality of irregularly spaced protrusions or variable length and variable depth may form a rag edge or a deckled edge that allows for a seamless transition between the repaired wall and the undamaged wall when painted.

17 Claims, 3 Drawing Sheets

(56) References Cited

U.S. PATENT DOCUMENTS

| | | | | |
|---|---|---|---|---|
| 9,624,664 | B2 | 4/2017 | Judd | |
| 9,885,184 | B2 * | 2/2018 | Gomes | E04F 13/06 |
| 2008/0116087 | A1 * | 5/2008 | Hathaway | C04B 40/0625 206/223 |
| 2008/0295435 | A1 * | 12/2008 | Uva | E04F 13/04 52/514 |
| 2012/0141735 | A1 | 6/2012 | Chevallier et al. | |
| 2012/0152439 | A1 * | 6/2012 | Hansen | E04G 23/0203 156/94 |
| 2016/0009055 | A1 | 1/2016 | Spadaro | |

* cited by examiner

WALL REPAIR APPARATUS

CROSS REFERENCE TO RELATED APPLICATIONS

This Application claims priority to U.S. Provisional Patent Application Ser. No. 62/383,554 filed 4 Sep. 2016, the disclosure of which is herein incorporated by reference in its entirety.

BACKGROUND OF THE INVENTION

Wall repair has traditionally been a labor intensive job requiring a high level of skill to achieve quality results. The home repair industry has failed to create a wall repair apparatus that is not only simple to use, but provides a finished repair which is of similar quality to a professional repair. Traditional wall repair requires the mixing of a repair compound, placement of a drywall tape, and administering the wet compound to the prepared area. The user must then wait for the compound to dry before sanding down the repaired wall section, and applying paint. Even when done by a professional, these repairs often fail to seamlessly merge the repaired section of wall with the undamaged section of wall.

Solutions provided by prior art fail to enable users to easily create seamless edges between the repaired section of wall and the undamaged section. Other wall patches have been created for ease of use, but they fail to provide edges which allow for a seamless finish once painted. Prior patches have attempted to break up the outline of the patch by using an uneven perimeter, but these patches still result in a finished repair with variation between the finish of the repaired wall and the finish of the unrepaired wall. And, unless the paint is thick, the uneven edge of these patches is visible. These patches also fail to provide support for the repair. The bodies of past patches have been substantially planar, and have failed to provide a patch which is customized to the damaged surface of the wall.

What is needed is a wall repair apparatus which is easy to use, but also allows for a seamless edge for the repair. The industry would also benefit from a wall patch which is designed specifically for the damaged section of wall being repaired, allowing for a more precise repair.

SUMMARY OF THE INVENTION

Disclosed herein is a wall repair apparatus that allows for a seamless edge when painted. The apparatus is affordable and easy to use. Moreover, the apparatus may be customized to fit the specific damage of the wall.

The wall repair apparatus may comprise a body having a top surface, a bottom surface, and a perimeter surrounding the body, wherein the perimeter comprises a plurality of irregularly spaced protrusions of variable length and variable depth. The plurality of irregularly spaced protrusions may overlap and form pockets in the perimeter and/or holes through the perimeter. In certain embodiments, the irregularly spaced protrusions form a rag edge or a deckled edge. The top surface may be substantially planar or convex. The bottom surface may be substantially planar, concave, or substantially conform to the counter of a damaged wall.

The apparatus may be made of a fibrous material such as paper or a synthetic polymer, a metal, and a mineral.

The apparatus length, width, or thickness may be varied based upon the dimensions of the damaged wall surface.

The apparatus can be directly applied to the damaged wall surface and the perimeter allows the apparatus to be painted over to create a seamless transition from the repaired surface to the undamaged surface.

DETAILED DESCRIPTION OF THE INVENTION

Disclosed herein are wall repair apparatuses and methods of use. The wall repair apparatus comprises a perimeter composed of a plurality of irregularly spaced protrusions of variable lengths and variable depth. The aforementioned perimeter allows the wall repair apparatus to become difficult to differentiate from the undamaged wall.

The advantages of the perimeter are multifold. First, paint is able to fill in pockets and holes formed from the irregularly spaced protrusions and from the varying depths of the edge. Second, the holes in the edge allow the surface of the wall to show through. Third, the variable depth of the perimeter mimics undamaged surfaces that may be textured or have brush or roller marks. These advantages, individually or collectively, allow the apparatus to seamlessly transition between the apparatus and the surrounding area when painted.

Figure 1:
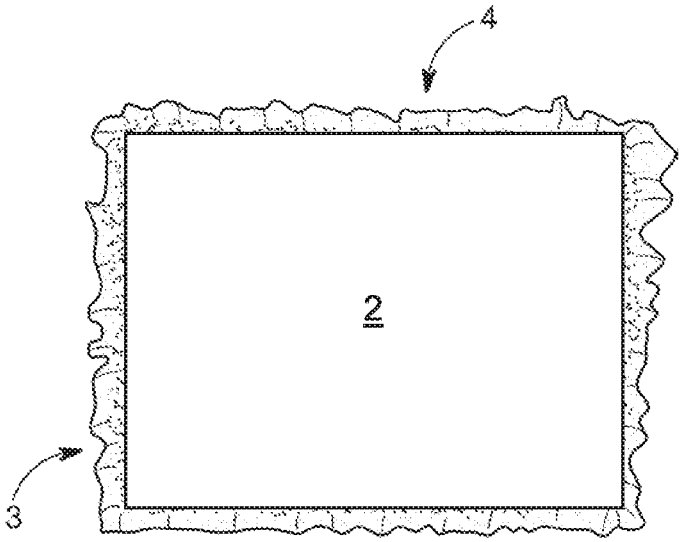
FIG. 1 is an overhead view of an exemplary wall repair apparatus with a rag edge or deckled edge.

An exemplary embodiment of the invention is illustrated in FIG. 1. As shown, the wall repair apparatus comprises a body 2 and perimeter comprised of a plurality of irregularly spaced protrusions of variable length and variable depth 3 surrounding the body.

Figure 2:
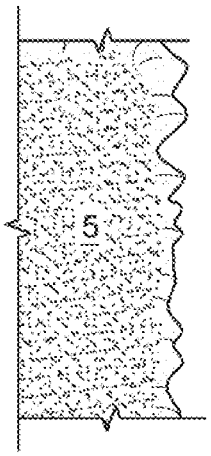
FIG. 2 is a close-up of the rag edge or deckled edge of FIG. 1, illustrating the uneven thickness of the edge as well as the irregular pattern along the circumference of the edge.

FIG. 2 shows a blown up portion of the upper right corner of the perimeter 5 to highlight the plurality of irregularly spaced protrusions of variable length and variable depth that overlap and form pockets in the perimeter, holes through the perimeter, or both pockets in and holes through the perimeter. As a result, the perimeter 5 may form a deckled edge or rag edge. A "deckled edge" refers to a rough edge having similar appearance and form to the rough, irregular, and uncut edge typically of paper or other fibrous products created by a deckle. A "rag edge" refers to a similarly rough, irregular edge as a deckled edge but prepared from other materials, such as synthetic polymer. The rough, deckled edge or rag edge breaks up the outline of the apparatus while also having pockets and/or holes for paint to enter when applied. This unique feature of the present invention allows for the seamless transition from the undamaged wall to the wall repair apparatus.

The wall repair apparatus may comprise a top surface and/or a bottom surface. In some embodiments, the top surface is substantially planar. A substantially planar top surface may be well suited to repair damage that is not uneven at the surface. A substantially planar top surface may also be well suited when the body of the patch substantially conforms to the contours of a damaged wall.

In other embodiments, the top surface is convex. Walls that have damage that protrudes outward or is uneven may benefit from using a patch with a subtly convex upper surface. The subtle curvature of the convex top surface makes uneven damage under the patch difficult to discern as the patch gets thinner and thinner to the edges. This creates an illusion of an even wall.

In some embodiments, the bottom surface is substantially planar. A substantially planar bottom surface may be well suited for surface damage that does not compromise the structural integrity of the wall. A substantially planar bottom surface may be well suited if the apparatus is made of a strong and/or rigid material.

In other embodiments, the bottom surface may be a concave surface. A concave bottom surface may be particularly useful in providing structural support on the bottom, sides, and top. In addition, a concave surface may be useful in saving on material costs.

In yet other embodiments, the bottom surface may be a surface that substantially conforms to contours of the damaged wall. Embodiments of this type comprise materials that can expand to fill the space of the damaged area. Materials of this sort may comprise water-absorbing plastics.

Figure 3:
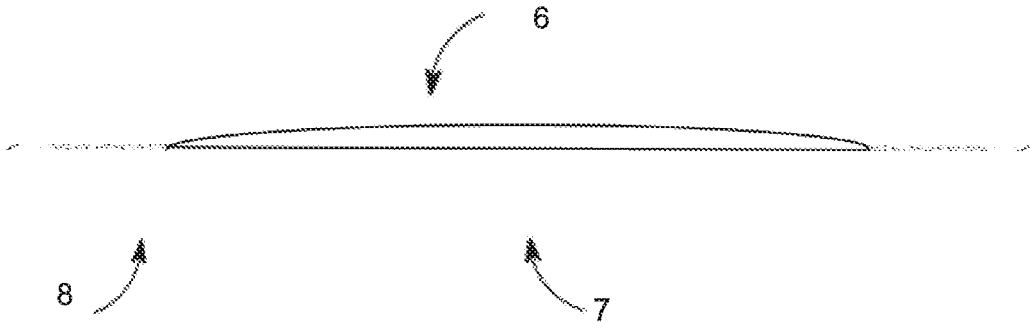
FIG. 3 is a cross-sectional view of an exemplary apparatus, illustrating the convex top surface, plano bottom surface, and rag or deckled edge.
Figure 4:
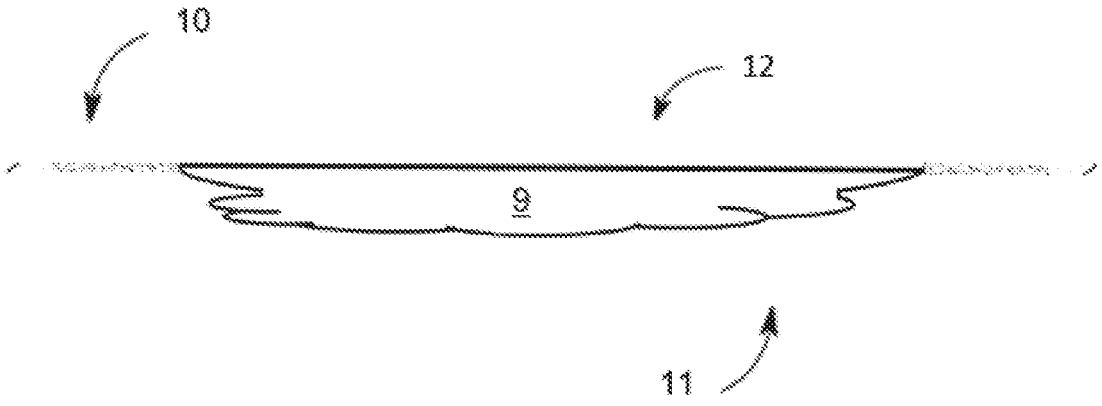
FIG. 4 is a cross-sectional view of an exemplary apparatus, illustrating a substantially planar top surface having a rag edge or a deckled edge and a bottom surface that can be created to fit an arbitrary contour of a damaged wall.
Figure 5:
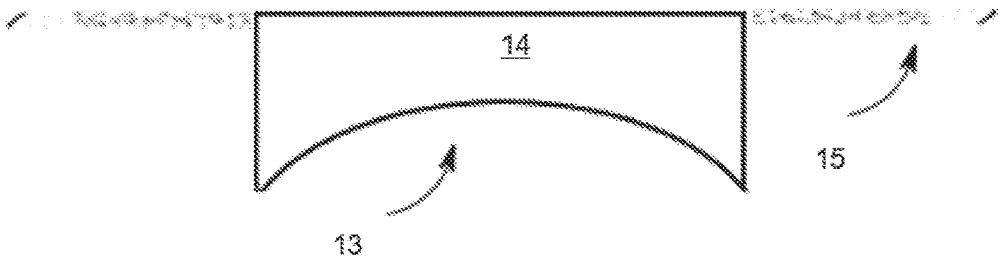
FIG. 5 is a cross-sectional view of a slice of an exemplary apparatus, illustrating a substantially planar top surface having a rag edge or a deckled edge and a convex bottom surface.

Several embodiments of the invention are presented in FIGS. 3-5. FIG. 3 illustrates a cross-section of a wall repair apparatus comprising a convex top surface 6, a substantially planar bottom surface 7, and a deckled edge or a rag edge 8. FIG. 4 illustrates a cross-section of a wall repair apparatus comprising a body 9, a substantially planar top surface 12, a bottom surface that conforms to contours of a damaged wall 11, and a deckled edge or a rag edge 10. FIG. 5 illustrates a cross-section of a wall repair apparatus comprising a body 14, a substantially planar top surface, a concave bottom surface 13, and a deckled edge or a rag edge 15. Those of skill in the art will appreciate that apparatuses having other forms are within the scope of the invention The wall repair apparatus may be used by applying the patch to a damaged area. An adhesive may be applied to the bottom surface of the body and/or the bottom of the edge to allow for attachment to the wall. In other embodiments the apparatus has an adhesive preapplied to the bottom surface of the body and/or the bottom of the edge. The patch is placed over the damaged area, with the deckled or rag edge placed onto the undamaged area. In some cases, a portion of the body may also be placed onto the undamaged area as well. After the apparatus is affixed to the wall, the user may paint over the patch and the damaged area.

An optional step may include the user filling the damaged area with plaster or other such material prior to positioning the apparatus over the damaged area before or after drying of the wet plaster.

The wall repair apparatus may be prepared by any suitable method. In some embodiments, the patches can be made using 3D printing technologies to add the irregularly spaced protrusions of variable length and variable depth. Other manufacturing techniques also can be used, such as those common in the paper manufacturing industry.

Various materials would be appropriate for the top surface, bottom surface, and rag edge depending upon the level of structural support required by the patch, including fibrous materials, synthetic polymers, metals, and minerals. One with skill in the art will be able to select a material based upon the composition of the surrounding wall, to create a patch that matches the look of the wall while providing the necessary support for the apparatus. Exemplary fibrous materials include, without limitation, wool, hemp, cotton, linen, recycled paper, recycled fibers, sugar cane fiber, or wood pulp. Exemplary synthetic polymers include, without limitation, polylactic acid (PLA), acrylonitrile butadiene styrene (ABS), stereo lithography materials (epoxy resins), photopolymers, water absorbing plastics, polycarbonates, glass filled polyamide, or polyamide (nylon). Exemplary metals include, without limitation, titanium or steel. Exemplary minerals include, without limitation, plaster, a ceramic, a stone material, or an aluminide. Cost and the material of the damaged wall or surface will be the determining factors in choice of suitable materials to create the patches.

In some embodiments, the wall repair apparatus comprises more than one material. In particular embodiments, the apparatus comprises a plaster-based printing medium for the bottom surface and a wood pulp printing medium for the top surface and edge.

Those skilled in the art will immediately understand that the size of the apparatus will vary based upon the extent and depth of the damage to the wall being repaired. For the apparatus to provide support when pressed down, the optimal distance between the top surface and the bottom surface is equivalent to the depth of the damaged wall. In one embodiment the maximum distance between the substantially planar surface and the top point of the convex surface is 140 mils or approximately 3.6 mm.

While there have been shown and described the basic novel features of the invention as applied to the preferred embodiment, it will be understood that various omissions and substitutions and changes in the form and details of the apparatus illustrated may be made by those skilled in the art without departing from the spirit of the invention. It is the intention, therefore, to be limited only as indicated by the scope of the following claims.

The invention claimed is:

1. A wall repair apparatus comprising a body having a top surface, a bottom surface having an adhesive applied thereto for adhering the apparatus to a wall, and a perimeter surrounding the body, wherein the perimeter comprises a plurality of irregularly spaced protrusions of variable length and variable depth and the plurality of irregularly spaced protrusions overlap and form pockets in the perimeter, holes through the perimeter, or both pockets in and holes through the perimeter.

2. The apparatus of claim 1, wherein the irregularly spaced protrusions form a rag edge or a deckled edge.

3. The apparatus of claim 1, wherein the top surface is a substantially planar surface.

4. The apparatus of claim 1, wherein the top surface is a convex surface.

5. The apparatus of claim 1, wherein the bottom surface is a substantially planar surface, a concave surface, or a surface that substantially conforms to the contour of a damaged wall.

6. The apparatus of claim 1, wherein the apparatus comprises one or materials selected from the group consisting of a fibrous material, a synthetic polymer, a metal, and a mineral.

7. The apparatus of claim 6, wherein the fibrous material is selected from the group consisting of wool, hemp, cotton, linen, recycled paper, recycled fibers, sugar cane fiber, and wood pulp.

8. The apparatus of claim 6, wherein the synthetic polymer is selected from the group consisting of polylactic acid (PLA), acrylonitrile butadiene styrene (ABS), stereo lithography materials (epoxy resins), photopolymers, water absorbing plastics, polycarbonates, glass filled polyamide, and polyamide (nylon).

9. The apparatus of claim 6, wherein the metal is selected from the group consisting of titanium and steel.

10. The apparatus of claim 6, wherein the mineral is selected from the group consisting of a plaster, a ceramic, a stone material, and an aluminide.

11. The apparatus of claim 1, wherein the maximum distance between the bottom surface and the top surface is 140 mil.

12. A wall repair apparatus comprising a body having a top surface, a bottom surface having an adhesive applied thereto for adhering the apparatus to a wall, and an edge where the top surface and bottom surface join, wherein the edge is a rag edge or a deckled edge and wherein the rag edge or the deckled edge is formed from a plurality of overlapping irregularly spaced protrusions of variable length and variable depth.

13. The apparatus of claim 12, wherein the rag edge or the deckled edge has pockets, holes, or both pockets and holes.

14. The apparatus of claim 12, wherein the top surface is a substantially planar surface or a convex surface.

15. The apparatus of claim 12, wherein the bottom surface is a substantially planar surface, a concave surface, or a surface that substantially conforms to the contour of a damaged wall.

16. The apparatus of claim 12, wherein the apparatus comprises one or materials selected from the group consisting a fibrous material, a synthetic polymer, a metal, and a mineral.

17. A wall repair apparatus comprising a solid body having a top surface, a bottom surface having an adhesive applied thereto for adhering the apparatus to a wall, and a porous edge where the top surface and bottom surface join, wherein the porous edge is a rag edge or a deckled edge having holes through the perimeter and wherein the rag edge or the deckled edge is formed from a plurality of overlapping irregularly spaced protrusions of variable length and variable depth.

* * * * *